US010980286B2

(12) United States Patent
Qiu

(10) Patent No.: US 10,980,286 B2
(45) Date of Patent: Apr. 20, 2021

(54) ATOMIZER AND AEROSOL GENERATING APPARATUS

(71) Applicant: JOYETECH EUROPE HOLDING GMBH, Zug (CH)

(72) Inventor: Weihua Qiu, Changzhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 17 days.

(21) Appl. No.: 16/679,072

(22) Filed: Nov. 8, 2019

(65) Prior Publication Data

US 2020/0068955 A1 Mar. 5, 2020

Related U.S. Application Data

(62) Division of application No. 15/537,399, filed on Jun. 16, 2017, now Pat. No. 10,477,899.

(30) Foreign Application Priority Data

Jun. 19, 2015 (CN) ..... 201520426365.0

(51) Int. Cl.
*A24F 47/00* (2020.01)

(52) U.S. Cl.
CPC ..... *A24F 47/008* (2013.01); *A24F 47/00* (2013.01)

(58) Field of Classification Search
CPC ..... A24F 40/485; A24F 47/008
See application file for complete search history.

(56) References Cited

U.S. PATENT DOCUMENTS

2018/0027874 A1* 2/2018 Zhu ..... H05B 3/03
2018/0035718 A1* 2/2018 Liu ..... A61M 15/06

* cited by examiner

*Primary Examiner* — Eric Yaary
(74) *Attorney, Agent, or Firm* — Cheng-Ju Chiang

(57) ABSTRACT

An atomizer includes a top cover, a bottom seat, and an atomizing assembly mounted between the top cover and the bottom seat. The top cover includes a mouthpiece and a liquid injection member mounted on one end of the mouthpiece. The atomizing assembly includes a first pressing ring and a fixing member fixed on one end of the first pressing ring. The fixing member is sleeved on the liquid injection member, and the liquid injection member is able to move along an axial direction of the atomizer, to cause the liquid injection member separating apart from the first pressing ring for adding cigarette liquid. An aerosol generating apparatus with the atomizer is also provided.

8 Claims, 5 Drawing Sheets

ATOMIZER AND AEROSOL GENERATING APPARATUS

CROSS REFERENCE TO RELATED APPLICATION

This application is a divisional application of U.S. patent application Ser. No. 15/537,399, filed on Jun. 16, 2017, which is a 35 U.S.C. § 371 National Phase conversion of International (PCT) Patent Application No. PCT/CN2016/086295, filed on Jun. 17, 2016, which claims the priority of Chinese Patent Application No. 201520426365.0, filed on Jun. 19, 2015. The contents of the above-identified applications are incorporated herein by reference.

TECHNICAL FIELD

The present application relates to aerosol generating apparatus, and more particularly to an atomizer that is convenient to add cigarette liquid and an aerosol generating apparatus with the atomizer.

BACKGROUND

The electronic cigarette, also known as virtual cigarette, or electronic atomization device, is one kind of electrical heating type aerosol generating apparatus. Currently on the market, a conventional electronic cigarette generally adopts the way of adding cigarette liquid from the bottom side of the electronic cigarette. In adding cigarette liquid, it is required to remove the bottom cover and invert the electronic cigarette, which is very inconvenient. Further, due to the functional requirements of adding cigarette liquid from the bottom side, the bottom cover is difficult to be completely sealed, thereby easily leading to a leakage of cigarette liquid.

SUMMARY

In view of the above problem, it is necessary to provide an atomizer that is convenient for adding cigarette liquid and an aerosol generating apparatus with the atomizer.

An atomizer includes a top cover, a bottom seat, and an atomizing assembly mounted between the top cover and the bottom seat, wherein the top cover includes a mouthpiece and a liquid injection member mounted on one end of the mouthpiece, the atomizing assembly includes a first pressing ring and a fixing member fixed on one end of the first pressing ring, the fixing member is sleeved on the liquid injection member, and the liquid injection member is able to move along an axial direction of the atomizer, to cause the liquid injection member separating apart from the first pressing ring for adding cigarette liquid.

In one embodiment, the atomizing assembly includes an elastic member, the elastic member is sleeved on the liquid injection member, when the liquid injection member moves downwardly along the axial direction of the atomizer to compress the elastic member, the liquid injection member is separated apart from the first pressing ring for adding cigarette liquid, when the elastic member restores, the liquid injection member comes back to its original position and is sealed with the first pressing ring.

In one embodiment, the liquid injection member includes a first connecting part and a second connecting part connected with the first connecting part, the mouthpiece is detachably mounted to one end of the first connecting part that is far away from the second connecting part.

In one embodiment, the top cover further includes a first sealing element, the second connecting part has a swallow-tailed cross section, one end of the second connecting part with smaller diameter is connected with the first connecting part, an outer surface of the second connecting part is provided with a receiving groove, the first sealing element is disposed in the receiving groove for sealing the first pressing ring and the liquid injection member.

In one embodiment, one end of the second connecting part that is far away from the first connecting part is provided with a sleeve extending along an axial direction of the liquid injection member, the elastic member is sleeved on the sleeve, one end of the fixing member is provided with an abutting portion extending radially inwardly towards the center of the fixing member, one end of the elastic member abuts against the liquid injection member, the other end of the elastic member abuts against the abutting portion.

In one embodiment, one end of the second connecting part that is far away from the first connecting part is provided with a stopping part extending along the axial direction of the liquid injection member, the sleeve and the stopping part are coaxially arranged with the stopping part being disposed at an outer side of the sleeve, a receiving portion is formed between the sleeve and the stopping part, one end of the elastic member abuts against the receiving portion.

In one embodiment, the liquid injection member is provided with an outer thread, the fixing member is provided with an inner thread corresponding to the outer thread, when the liquid injection member is rotated downwardly along the axial direction of the atomizer, the liquid injection member is separated apart from the first pressing ring for adding cigarette liquid, when the liquid injection member is rotated upwardly, the liquid injection member comes back to its original position and is sealed with the first pressing ring.

In one embodiment, the liquid injection member includes a first connecting part and a second connecting part connected with the first connecting part, the mouthpiece is detachably mounted to one end of the first connecting part that is far away from the second connecting part.

In one embodiment, one end of the second connecting part that is far away from the first connecting part is provided with a sleeve extending along an axial direction of the liquid injection member, the outer thread is formed on the sleeve.

An aerosol generating apparatus with either one of the above atomizers.

An atomizer includes a top cover and an atomizing assembly, wherein the top cover includes a liquid injection member, the atomizing assembly includes a first pressing ring and an inner tube for storing cigarette liquid, the first pressing ring is disposed at one end of the inner tube, the first pressing ring is communicated with an interior of the inner tube, the liquid injection member is disposed inside the first pressing ring, the liquid injection member is able to move along an axial direction of the atomizer, to cause the liquid injection member separating apart from the first pressing ring for adding cigarette liquid or to cause the liquid injection member sealing with the first pressing ring.

In one embodiment, the atomizing assembly further includes a fixing member, the fixing member is arranged between the first pressing ring and the inner tube, the fixing member is sleeved on the liquid injection member.

In one embodiment, the atomizing assembly further includes an elastic member, the elastic member is sleeved on the liquid injection member, when the liquid injection member moves downwardly along the axial direction of the atomizer to compress the elastic member, the liquid injection member is separated apart from the first pressing ring for adding cigarette liquid, when the elastic member restores, the liquid injection member comes back to its original position and is sealed with the first pressing ring.

In one embodiment, the top cover further includes a first sealing element, the liquid injection member includes a first connecting part and a second connecting part connected with the first connecting part, the second connecting part has a swallow-tailed cross section, one end of the second connecting part with smaller diameter is connected with the first connecting part, an outer surface of the second connecting part is provided with a receiving groove, the first sealing element is disposed in the receiving groove for sealing the first pressing ring and the liquid injection member.

In one embodiment, one end of the second connecting part that is far away from the first connecting part is provided with a sleeve extending along an axial direction of the liquid injection member, the elastic member is sleeved on the sleeve, one end of the fixing member is provided with an abutting portion extending radially inwardly towards the center of the fixing member, one end of the elastic member abuts against the liquid injection member, the other end of the elastic member abuts against the abutting portion.

In one embodiment, one end of the second connecting part that is far away from the first connecting part is provided with a stopping part extending along the axial direction of the liquid injection member, the sleeve and the stopping part are coaxially arranged with the stopping part being disposed at an outer side of the sleeve, a receiving portion is formed between the sleeve and the stopping part, one end of the elastic member abuts against the receiving portion.

In one embodiment, the liquid injection member is provided with an outer thread, the fixing member is provided with an inner thread corresponding to the outer thread, when the liquid injection member is rotated downwardly along the axial direction of the atomizer, the liquid injection member is separated apart from the first pressing ring for adding cigarette liquid, when the liquid injection member is rotated upwardly, the liquid injection member comes back to its original position and is sealed with the first pressing ring.

In one embodiment, the liquid injection member includes a first connecting part and a second connecting part connected with the first connecting part, one end of the second connecting part that is far away from the first connecting part is provided with a sleeve extending along an axial direction of the liquid injection member, the outer thread is formed on the sleeve.

In one embodiment, the atomizing assembly further includes an atomizing unit disposed in the inner tube, the atomizing unit includes an atomizing head, a bottom cover mounted on one end of the atomizing head, and an atomizing pipe sleeved on the atomizing head, the bottom cover is provided with a first liquid inlet hole, the atomizing head is provided with a second liquid inlet hole communicating the first liquid inlet hole with an interior of the atomizing head, one end of the atomizing pipe opposite to the bottom cover is securely mounted with the liquid injection member, when the liquid injection member moves along the axial direction of the atomizer, the atomizing pipe is taken to move along the axial direction of the atomizer together, when the liquid injection member is separated apart from the first pressing ring, one end of the atomizing pipe opposite to the liquid injection member covers the first liquid inlet hole, when the liquid injection member is sealed with the first pressing ring, one end of the atomizing pipe opposite to the liquid injection member opens the first liquid inlet hole.

An aerosol generating apparatus with either one of the above atomizers.

The atomizer of the present application can be added with cigarette liquid conveniently from the top side of the atomizer by moving the liquid injection member axially. Thus, the atomizer has advantages of great convenience in adding cigarette liquid and good sealing effect. Since the atomizer adopts the way of adding cigarette liquid from the top side, the liquid leakage problem resulted due to the detachable connection between the atomizing assembly and the bottom cover is avoided.

Figure 1:
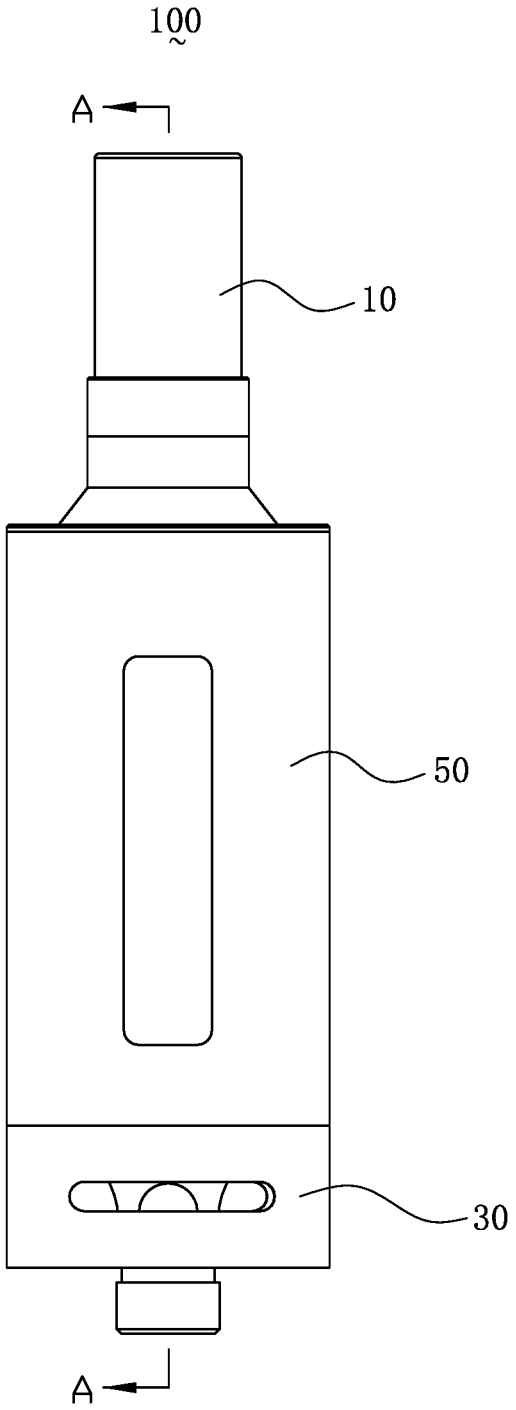
FIG. 1 is a front view of an atomizer according to a first embodiment of the present application.

atomizer 100, 200; top cover 10;
mouthpiece 11; liquid injection member 13;
first connecting part 131; second connecting part 133;
receiving groove 1331; sleeve 1333, 2133;
stopping part 1335; receiving portion 1337;
first sealing element 15; bottom seat 30;
atomizing assembly 50; first pressing ring 51;
main body 511; fixing portion 513;
fixing member 52; abutting portion 521, 611;
outer tube 53; inner tube 54;
second pressing ring 55; elastic member 57;
atomizing unit 59; atomizing head 591;
bottom cover 593; atomizing pipe 597;
outer thread 2135; inner thread 6115;
second sealing element 595; first liquid inlet hole 5931;
second liquid inlet hole 5911.

DETAILED DESCRIPTION OF PREFERRED EMBODIMENTS

In order to easily understand the purposes, characteristics and advantages of the present application, exemplary embodiments of the present application are described in detail with reference to the accompanying drawings. Many specific details are given in the following description to fully understand the present application, but the present application can be implemented by other ways different from the following description. A person in the art can make similar variations and improvements without departing from the spirit of the present application. Therefore, the present application is not restricted by the following concrete embodiments.

It should be noted that, when an element is referred to as being "mounted" on another element, it can be directly mounted on the other element, or mounted on the other element by intervening elements. When an element is referred to as being "connected" to another element, it can be directly connected to the other element, or connected to the other element by intervening elements.

Unless otherwise defined, all the technical terms in the present application have the meaning same to that understood by the technical person in the art. The terms in the description of the present application are only for the purpose of describing the specific embodiments, and are not intended to limit the present application. The use of the term "and/or" in the description includes any and all combinations of one or more of the listed items.

Figure 2:
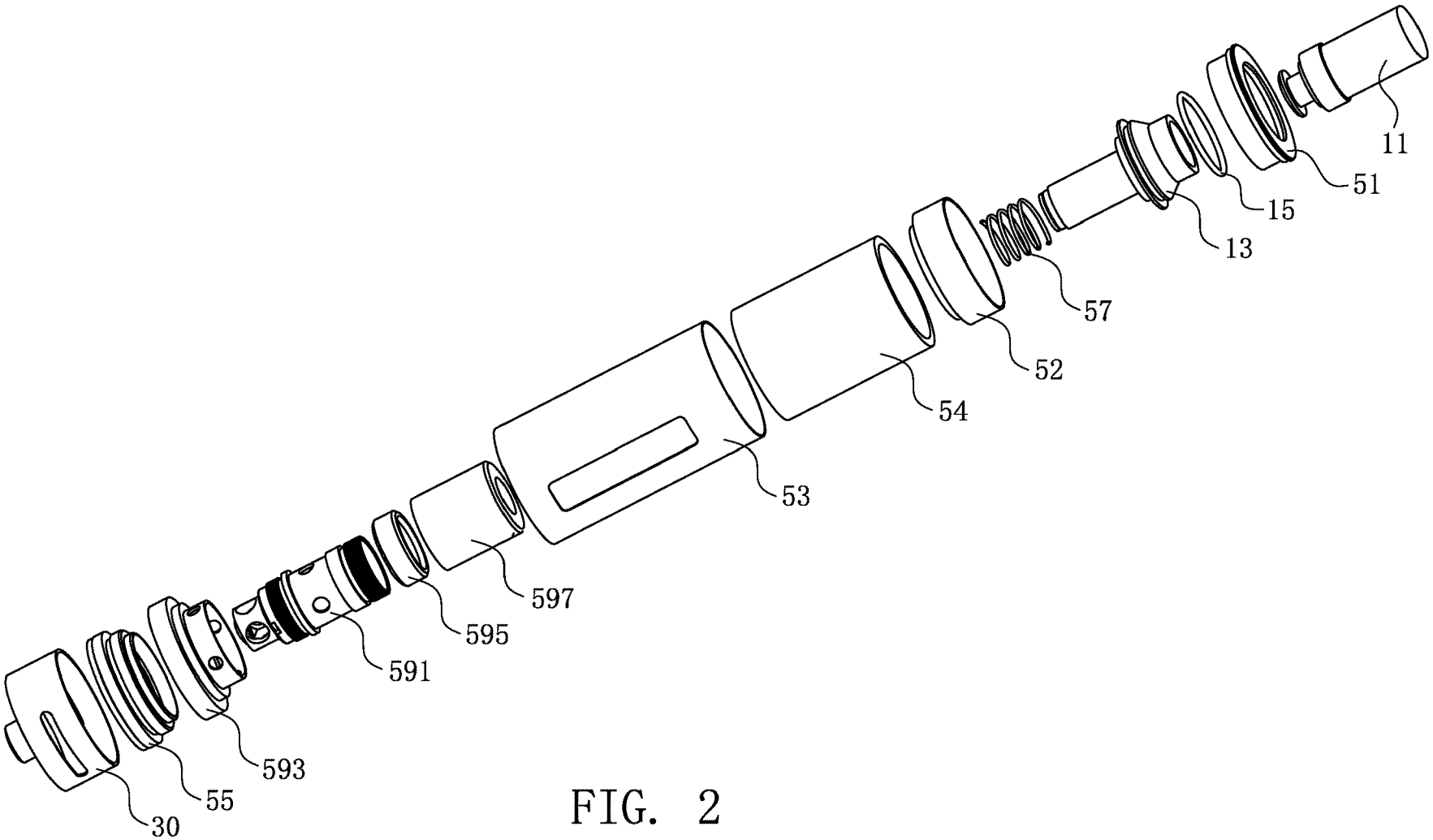
FIG. 2 is an exploded view of the atomizer of FIG. 1.
Figure 3:
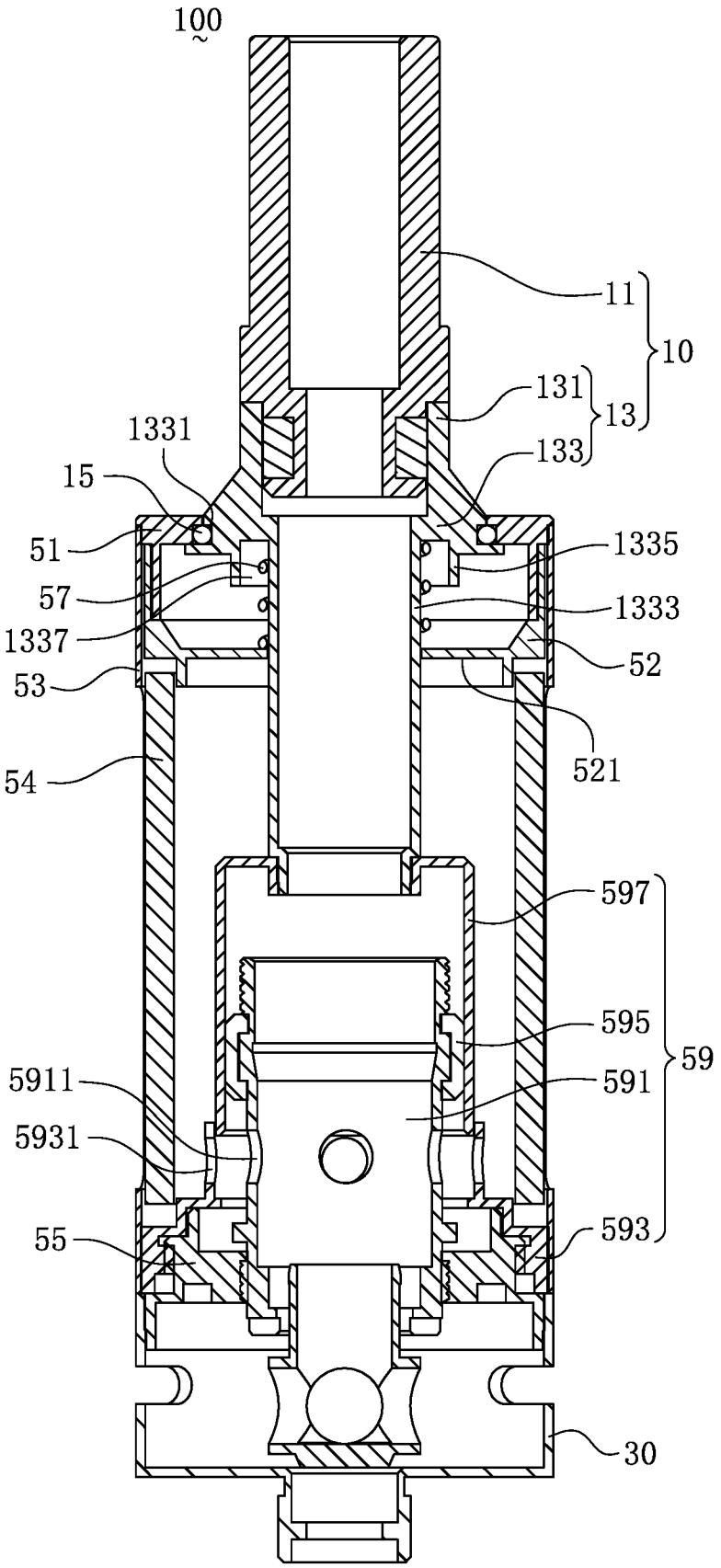
FIG. 3 is a cross sectional view of the atomizer of FIG. 1 along the line of A-A in the state of normal use.

With reference to FIGS. 1-3, a first embodiment of the present application provides an atomizer 100. The atomizer 100 includes a top cover 10, a bottom seat 30, and an atomizing assembly 50. The atomizing assembly 50 is mounted between the top cover 10 and the bottom seat 30.

The top cover 10 includes a mouthpiece 11, a liquid injection member 13 mounted on one end of the mouthpiece 11, and a first sealing element 15 mounted on the liquid injection member 13. The liquid injection member 13 is generally cylinder-shaped, and includes a first connecting part 131 and a second connecting part 133 connected with the first connecting part 131. The mouthpiece 11 is detachably mounted to one end of the first connecting part 131 that is far away from the second connecting part 133. The second connecting part 133 has a swallow-tailed cross section, one end of the second connecting part 133 with smaller diameter is connected with the first connecting part 131, the outer surface of the second connecting part 133 that is far away from the first connecting part 131 is provided with a receiving groove 1331, and the first sealing element 15 is disposed in the receiving groove 1331. A sleeve 1333 and a stopping part 1335 are extended along the axial direction of the liquid injection member 13 from one end of the second connecting part 133 that is far away from the first connecting part 131. The sleeve 1333 and the stopping part 1335 are coaxially arranged, the stopping part 1335 is disposed at an outer side of the sleeve 1333, and a receiving portion 1337 is formed between the sleeve 1333 and the stopping part 1335.

The atomizing assembly 50 includes a first pressing ring 51, a fixing member 52, an outer tube 53, an inner tube 54, a second pressing ring 55, an elastic member 57, and an atomizing unit 59. The inner tube 54 is disposed in the outer tube 53, the first pressing ring 51 and the second pressing ring 55 are respectively disposed at two ends of the outer tube 53, the atomizing unit 59 is disposed in the inner tube 54. In the embodiment, the inner tube 54 is a tube made of glass for storing cigarette liquid, the outer tube 54 is made of stainless steel material, the outer tube 54 is provided with a window (not labeled) for observing remaining volume of the cigarette liquid through the window. It is understood that the inner tube 54 may also be made of other transparent materials such as transparent plastics, the outer tube 53 may also be made of plastics. Furthermore, if the inner tube 54 is made of transparent plastics, the outer tube 53 can be omitted.

The first pressing ring 51 includes a cylindrical main body 511, one end of the main body 511 adjacent to the top cover 10 is formed with a fixing portion 513 extending radially inwardly towards the center of the main body 511. The fixing member 52 is movably sleeved on the sleeve 1333, one end of the fixing member 52 is provided with an abutting portion 521 extending radially inwardly towards the center of the fixing member 52. The elastic member 57 is a spring, which is movably sleeved on the sleeve 1333. One end of the elastic member 57 abuts against the receiving portion 1337, and the other end of the elastic member 57 abuts against the abutting portion 521. It is understood that the stopping part 1335 mainly acts for the purpose of limiting, the stopping part 1335 can be omitted, and the elastic member 57 directly abuts against the liquid injection member 13.

The atomizing unit 59 includes an atomizing head 591, a bottom cover 593 mounted on one end of the atomizing head 591, a second sealing element 595 mounted on the other end of the atomizing head 591, and an atomizing pipe 597. The atomizing pipe 597 surrounds the atomizing head 591, and the second sealing element 595 is disposed in the atomizing pipe 597 and is in sealing contact with the sidewall of the atomizing pipe 597. One end of the atomizing pipe 597 is securely mounted with the sleeve 1333, and the other end of the atomizing pipe 597 is partially received in an opening of the bottom cover 593. The bottom cover 593 is installed on the second pressing ring 55, the second pressing ring 55 is installed on the bottom seat 30. The bottom cover 593 is provided with a first liquid inlet hole 5931 at the sidewall of one end of the bottom cover 593 in which the atomizing pipe 597 is received, and the atomizing head 591 is provided with a second liquid inlet hole 5911 in communication with an interior of the atomizing head 591. The first liquid inlet hole 5931 is used to communicate an interior of the inner tube 54 with the second liquid inlet hole 5911, such that the cigarette liquid stored in the inner tube 54 can enter the atomizing head 591 through the first liquid inlet hole 5931 and the second liquid inlet hole 5911.

Figure 4:
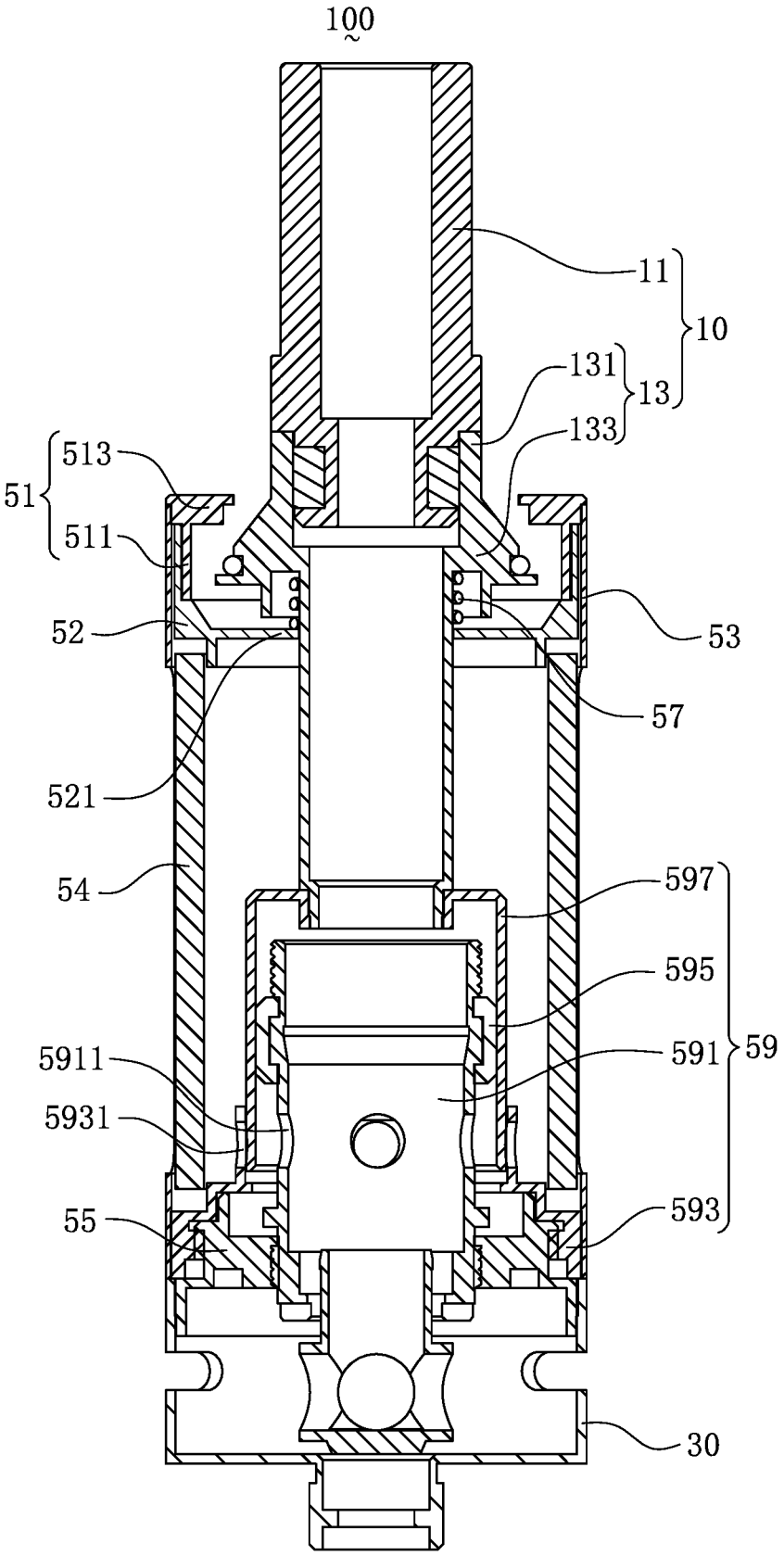
FIG. 4 is a cross sectional view of the atomizer of FIG. 1 along the line of A-A in the state of adding cigarette liquid.

FIG. 3 shows the atomizer 100 in the state of normal use. When the atomizer 100 is required to add cigarette liquid, as shown in FIG. 4, the top cover 10 is pushed to move downwardly along the axial direction of the atomizer 100, the elastic member 57 is then compressed, the fixing portion 513 of the first pressing ring 51 is separated apart from the liquid injection member 13 in order to add cigarette liquid into the inner tube 54. After cigarette liquid is added, the top cover 10 is released, the top cover 10 restores back to the state of FIG. 3 under restoring force of the elastic member 57. In addition, the top end of the atomizing pipe 597 is mounted with the sleeve 1333, hence, when the top cover 10 moves downwardly along the axial direction of the atomizer 100, the atomizing pipe 597 moves downwardly together with the top cover 10. As a result, the bottom end of the atomizing pipe 597 received in the bottom cover 593 covers the first liquid inlet hole 5931, during the course of adding cigarette liquid by user, the cigarette liquid in the inner tube 54 is prevented from entering the second liquid inlet hole 5911 via the first liquid inlet hole 5931 under pressure, accordingly, the cigarette liquid is prevented from entering the atomizing head 591 and spilling out from an air intake hole (not labeled) of the atomizing head 591.

In the embodiment, the abutting portion 521 has an annular shape and is provided with at least an opening (not shown) thereon for passage of cigarette liquid.

Figure 5:
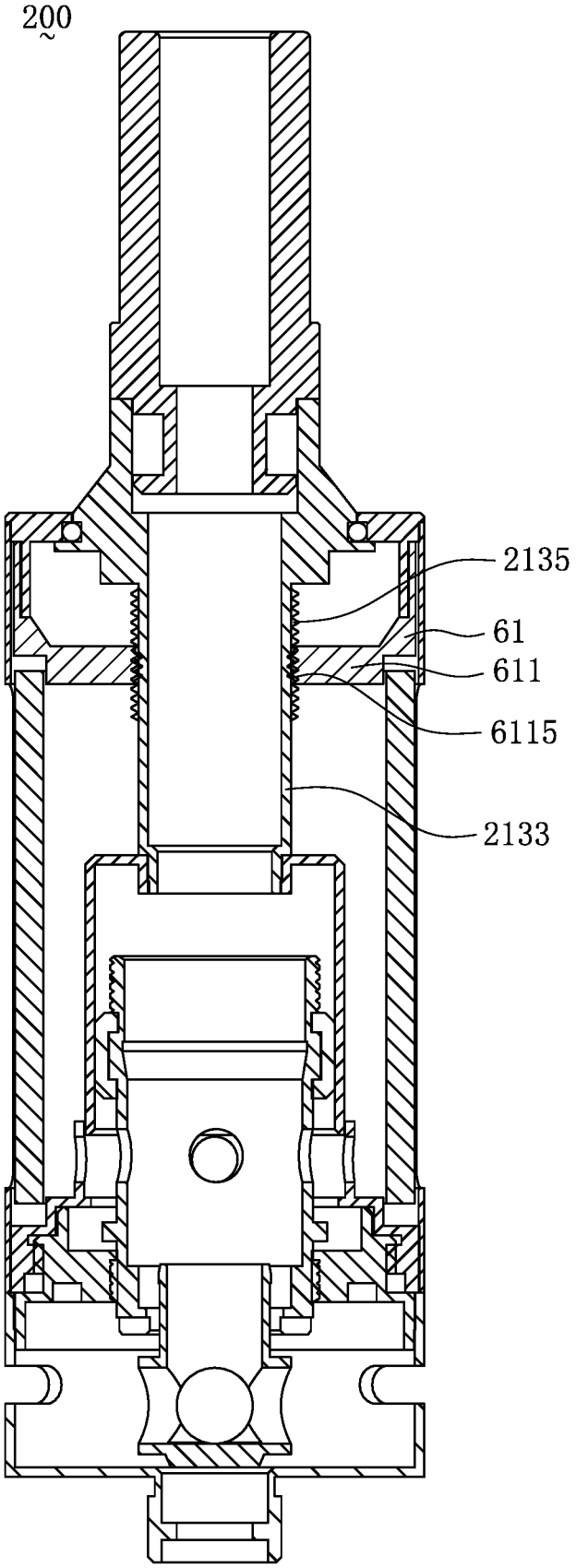
FIG. 5 is a cross sectional view of an atomizer in the state of normal use according to a second embodiment of the present application.

Referring to FIG. 5, an atomizer 200 according to the second embodiment of the present application is mainly the same as the atomizer 100 of the first embodiment, the difference lies in that, the outer surface of the sleeve 2133 of the atomizer 200 is provided with an outer thread 2135, the abutting portion 611 of the fixing member 61 is provided with an inner thread 6115 corresponding to the outer thread 2135. The combination of the outer thread 2135 and the inner thread 6115 has replaced the spring 57 of the first embodiment, for adding cigarette liquid from the top side.

The above atomizers of the present application can be used in an aerosol generating apparatus. Due to the use of the spring 57 or the threaded structure, cigarette liquid can be easily and conveniently added from the top side of the atomizer. Thus, the atomizer has advantages of convenience in adding cigarette liquid and good sealing effect.

The above embodiments described in detail are several embodiments of the present application only, and should not be deemed as limitations to the scope of the present application. It should be noted that variations and improvements will become apparent to those skilled in the art to which the present application pertains without departing from its spirit. Therefore, the scope of the present application is defined by the appended claims.

What is claimed is:

1. An atomizer comprising a top cover and an atomizing assembly, wherein the top cover comprises a liquid injection member, the atomizing assembly comprises a first pressing ring and an inner tube for storing cigarette liquid, the first pressing ring is disposed at one end of the inner tube, the first pressing ring is communicated with an interior of the inner tube, the liquid injection member is disposed inside the first pressing ring, the liquid injection member is able to move along an axial direction of the atomizer, to cause the liquid injection member separating apart from the first pressing ring for adding cigarette liquid, or to cause the liquid injection member sealing with the first pressing ring, wherein the atomizing assembly further comprises a fixing member, the fixing member is arranged between the first pressing ring and the inner tube, the fixing member is sleeved on the liquid injection member, wherein the atomizing assembly further comprises an elastic member, the elastic member is sleeved on the liquid injection member, when the liquid injection member moves downwardly along the axial direction of the atomizer to compress the elastic member, the liquid injection member is separated apart from the first pressing ring for adding cigarette liquid, when the elastic member restores, the liquid injection member comes back to its original position and is sealed with the first pressing ring.

2. The atomizer of claim 1, wherein the top cover further comprises a first sealing element, the liquid injection member comprises a first connecting part and a second connecting part connected with the first connecting part, the second connecting part has a swallow-tailed cross section, one end of the second connecting part with smaller diameter is connected with the first connecting part, an outer surface of the second connecting part is provided with a receiving groove, the first sealing element is disposed in the receiving groove for sealing the first pressing ring and the liquid injection member.

3. The atomizer of claim 1, wherein one end of the second connecting part that is far away from the first connecting part is provided with a sleeve extending along an axial direction of the liquid injection member, the elastic member is sleeved on the sleeve, one end of the fixing member is provided with an abutting portion extending radially inwardly towards the center of the fixing member, one end of the elastic member abuts against the liquid injection member, the other end of the elastic member abuts against the abutting portion.

4. The atomizer of claim 3, wherein one end of the second connecting part that is far away from the first connecting part is provided with a stopping part extending along the axial direction of the liquid injection member, the sleeve and the stopping part are coaxially arranged with the stopping part being disposed at an outer side of the sleeve, a receiving portion is formed between the sleeve and the stopping part, one end of the elastic member abuts against the receiving portion.

5. The atomizer of claim 1, wherein the liquid injection member is provided with an outer thread, the fixing member is provided with an inner thread corresponding to the outer thread, when the liquid injection member is rotated downwardly along the axial direction of the atomizer, the liquid injection member is separated apart from the first pressing ring for adding cigarette liquid, when the liquid injection member is rotated upwardly, the liquid injection member comes back to its original position and is sealed with the first pressing ring.

6. The atomizer of claim 5, wherein the liquid injection member comprises a first connecting part and a second connecting part connected with the first connecting part, one end of the second connecting part that is far away from the first connecting part is provided with a sleeve extending along an axial direction of the liquid injection member, the outer thread is formed on the sleeve.

7. The atomizer of claim 1, wherein the atomizing assembly further comprises an atomizing unit disposed in the inner tube, the atomizing unit comprises an atomizing head, a bottom cover mounted on one end of the atomizing head, and an atomizing pipe sleeved on the atomizing head, the bottom cover is provided with a first liquid inlet hole, the atomizing head is provided with a second liquid inlet hole communicating the first liquid inlet hole with an interior of the atomizing head, one end of the atomizing pipe opposite to the bottom cover is securely mounted with the liquid injection member, when the liquid injection member moves along the axial direction of the atomizer, the atomizing pipe is taken to move along the axial direction of the atomizer together, when the liquid injection member is separated apart from the first pressing ring, one end of the atomizing pipe opposite to the liquid injection member covers the first liquid inlet hole, when the liquid injection member is sealed with the first pressing ring, one end of the atomizing pipe opposite to the liquid injection member opens the first liquid inlet hole.

8. An aerosol generating apparatus comprising the atomizer of claim 1.

* * * * *